United States Patent [19]

Fries

[11] Patent Number: 4,653,977

[45] Date of Patent: Mar. 31, 1987

[54] PUMP FOR MIXING AND PUMPING LIQUIDS

[75] Inventor: Hjalmar Fries, Spanga, Sweden

[73] Assignee: Flygt Aktienbolag, Solna, Sweden

[21] Appl. No.: 693,495

[22] Filed: Jan. 22, 1985

[30] Foreign Application Priority Data

Jan. 30, 1984 [SE] Sweden ..... 8400443

[51] Int. Cl.[4] ..... F04D 29/26

[52] U.S. Cl. ..... 415/38; 415/146; 366/190; 366/196

[58] Field of Search ..... 415/38, 121 R, 146, 415/152 A, 206, 219 C; 416/202; 366/190, 192, 196, 343

[56] References Cited

U.S. PATENT DOCUMENTS 3,048,117 8/1962 Franzen et al. ..... 415/121 R X 4,264,215 4/1981 Nunlist et al. ..... 366/343 X 4,519,715 5/1985 Golobic et al. ..... 416/202 X

FOREIGN PATENT DOCUMENTS 1049066 12/1953 France ..... 415/146

1142593 9/1957 France ..... 415/146

315321 4/1930 United Kingdom ..... 415/146

*Primary Examiner*—Robert L. Garrett

*Assistant Examiner*—Joseph M. Pitko

*Attorney, Agent, or Firm*—John T. O'Halloran; Mary C. Werner

[57] ABSTRACT

A pump for pumping and mixing of liquids containing suspensions comprises a housing having an impeller rotatable in both directions and a central inlet. The housing is provided with two outlets which are closed alternatively by a ball, depending on the rotation direction of the impeller.

7 Claims, 7 Drawing Figures

PUMP FOR MIXING AND PUMPING LIQUIDS

BACKGROUND OF THE INVENTION

This invention concerns a pump for pumping and mixing of liquids containing suspensions such as waste water, floating manure, water mixed with sand and minerals etc.

When pumping liquids of that sort it is often necessary to disperse the solid bodies in the liquid in a mixing phase prior to the pumping. This can be obtained by help of a separate mixer or by letting the pump bring the liquid back at a high speed. Sometimes the nozzle is mounted directly on the pump outlet, in other cases on a flap valve arranged on the pump housing. Such a solution is shown in the Swedish Pat. No. 7308851-0.

To use the same machine for pumping as well as mixing has of course an economic advantage, but there are certain drawbacks. The design will be more complex and in addition certain hydrodynamic compromises must be accepted as the pumping must take place through a pressure pipe, while the pump, during the mixing phase, lacks that pipe.

SUMMARY OF THE INVENTION

The invention solves these problems and makes a separate switch-over valve unnecessary. It also makes possible an optimum design of the impeller for both functions.

One feature of the present invention is the provision of a method of performing pumping and mixing operations using an impeller comprising the steps of rotating the impeller in one direction for the pumping operation and rotating the impeller in the opposite direction for the mixing operation.

Another feature of the present invention is the provision of an arrangement for pumping and mixing a fluid medium comprising a housing including a chamber having a central inlet and first outlet means, an impeller mounted for rotation in the chamber, and means for rotating the impeller in one direction for pumping and in the opposite direction for mixing.

BRIEF DESCRIPTION OF THE DRAWING

Above-mentioned and other features and objects of this invention will become more apparent by reference to the following description taken in conjunction with the accompanying drawings, in which.

DETAILED DESCRIPTION OF THE PREFERRED EMBODIMENT

Figure 1:
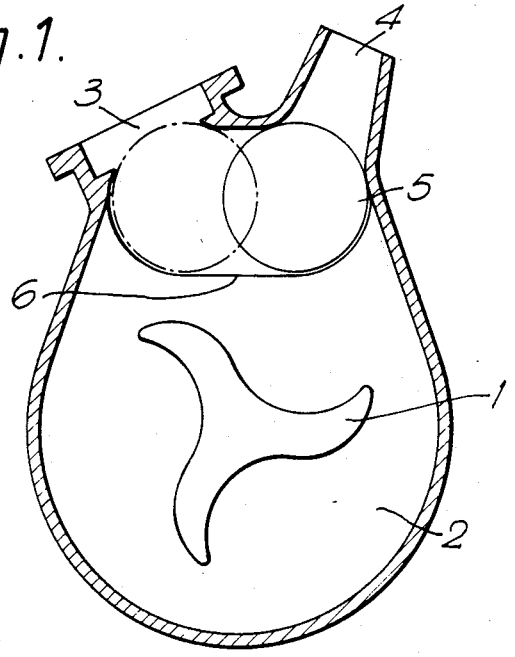
FIG. 1 is a cross-sectional view of the pump of this invention in the pumping condition.

The invention is described more closely with reference to the enclosed drawings. An impeller 1 is rotatable in two directions in a pump housing 2 which is provided with a central inlet (not shown) and two outlets 3 and 4. A ball 5 is movable along a guide or track 6.

The liquid is brought to the pump housing 2 via the central inlet. The impeller 1, which may rotate in both directions, pumps the liquid through either of the two outlets 3 and 4.

During clockwise rotation the ball 5 is moved to the right into the position shown in FIG. 1 and closes the outlet 4. The outlet 3 is then open and all liquid goes out through that outlet. When the impeller 1 rotates in the opposite direction, the ball 5 is moved to the left as considered in FIG. 1 into its position shown in dashed lines and closes the outlet 3. The outlet 4 is then open and all liquid goes out through the same. The two outlets 3 and 4 are connected to respective conduit means such that the desired outpumping takes place when the outlet 3 is open and roundpumping (mixing) takes place when the outlet 4 is open.

The switch over between the two outlets 3 and 4 is obtained by the ball 5 rolling on guides 6. However, it is also possible to use other automatically operated valve mechanisms, such as flaps, instead.

The valve arrangement which is influenced by the rotating fluid, may be designed as a known valve disc having its pivoting axis in the pump center or at a point between the two outlets 3 and 4.

Figure 2:
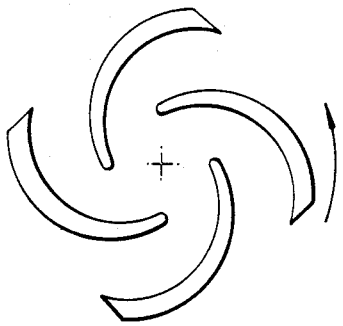
FIG. 2 is a diagrammatic illustration of a reactive blade impeller configuration.
Figure 3:
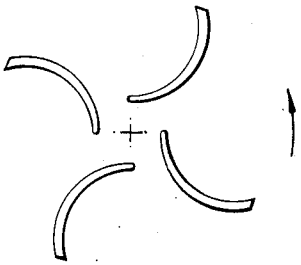
FIG. 3 is a diagrammatic illustration of an active blade impeller configuration.

A great advantage in using two rotation directions for the ipeller 1 is that it can be given two different hydrodynamic functions. The outlet angle of the impeller 1 is thus important to the characteristics of the flow and to the inclination of the pump curve. A reactive and an active blade can be distinguished from each other in that the former gives liquid a high pressure energy and the latter a high kinetic energy, i.e. velocity. The speed triangles for the two types and their diagrammatic configurations embodying the principles thereof are shown in FIG. 2 for reactive blades, which are the most common within the pump technique, and in FIG. 3 for active blades which are often used within the ventilation technique and in the former technique only in so-called free-flow pumps.

In order to obtain a good performance curve without putting an overload on the motor at any point, the reactive blade is to be preferred. Up to now one has however been forced to use an active blade design even during the mixing phase. The pressure has then been transferred from static to dynamic pressure in the nozzle. As only a high speed is wanted, it is, of course, preferable if the dynamic pressure is obtained as directly as possible, without a detour via a static pressure to avoid losses.

Figure 4:
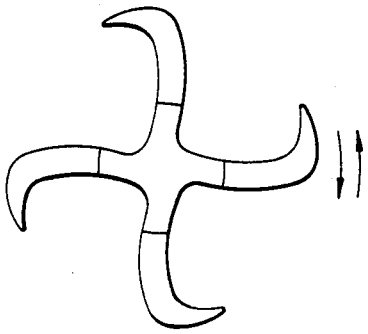
FIG. 4 is a diagrammatic view of an impeller configuration.
Figure 5:
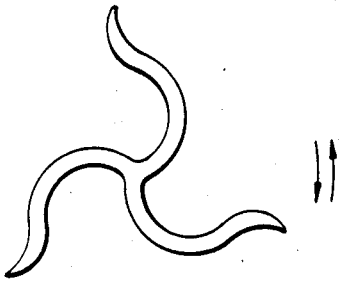
FIG. 5 is a cross section of a modified impeller configuration.
Figure 6:
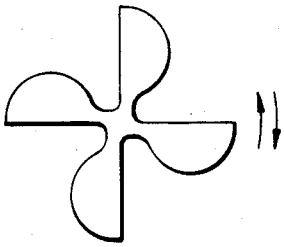
FIG. 6 is a cross section of a further modified impeller configuration.

According to the invention a suitable combination of a reactive behavior in one rotation direction and an active behavior in the other is obtained. Most important is the behavior on the pressure side. If the medium line in the impeller 1 is studied it has a forward bend, active form in one of the directions and a backward bend, reactive form in the other. The two blade sides of the impeller 1 may according to the invention be combined in such a way that the efficiency is optimal in both cases. This means that the motor is efficiently utilized and that no vibrations occur. Suitable impeller geometries are shown in FIGS. 4, 5 and 6.

It is also possible to design the interior of the pump housing so as to be active and reactive in the same way.

Normally the housing is designed with a conically increasing outlet and this may also be suitable for the pump according to the invention. When rotating in the opposite direction, when speed should be obtained, the housing is given a conically decreasing design towards the outlet where the speed is the highest. The reactive and active behaviors for the two rotation directions are thus intensified. It should however be observed that this is not a condition as even a cylindrical form in the housing is permissible.

The device according to the invention could be regarded as a reversible pump because of its easy shift between pumping with a static pressure and mixing with a dynamic pressure. The valve arrangement which is influenced by the rotating fluid, may be designed as a known valve disc having its pivoting axis in the pump center or at a point between the two outlets 3 and 4.

Figure 7:
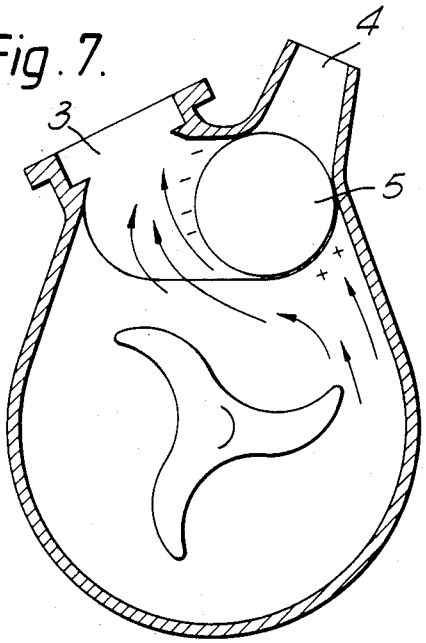
FIG. 7 is a view similar to FIG. 1 but showing the flow conditions existing at the commencement of the pumping operation.

A very good effect is however obtained with the valve ball 5 which rolls between the two outlets 3 and 4. The flow will initially follow the outer wall in the housing and hit the ball 5 in such a way that it is lifted from its then wrong position. As is shown in FIG. 7, the flow will, if the ball 5 takes the then wrong position, go around the ball and follow its surface towards the then wrong outlet. Because of the speed, an underpressure occurs which draws the ball 5 towards the then right position. The valve function will therefore be strong and distinct and so quick that the flow through the then wrong outlet is negligible.

The outlet 4 may take the form of a mixing nozzle and may have an ejector into which flowable material is supplied. The outlet 3 includes a connector for joining a pump conduit.

While I have described above the principles of my invention in connection with specific apparatus, it is to be clearly understood that this description is made only by way of example and not as a limitation to the scope of my invention as set forth in the objects thereof and in the accompanying claims.

I claim:

1. Apparatus for pumping and mixing a fluid medium comprising:

a housing including a chamber having a central inlet and first and second outlet means, said first outlet means extending from said chamber and housing and being configured for pumping and said second outlet means extending from said chamber and housing and being configured for mixing;

an impeller mounted in said chamber for rotation in one direction for pumping and in an opposite direction for mixing, said impeller having blades in at least a partly reactive configuration along one side to impart increased static pressure to said fluid medium when said impeller is rotated in said one direction for pumping, said blades of said impeller further having at least a partially active configuration along an opposite side to impart high speed by way of increased dynamic pressure to said fluid medium when said impeller is rotated in said opposite direction; and means responsive to said impeller being rotated in said one direction for closing said second outlet means to fluid medium flow and further responsive to said impeller being rotated in said opposite direction for closing said first outlet means to fluid medium flow.

2. The arrangement as claimed in claim 1 further comprising:

means for guiding said closing means for movement between said first and second positions.

3. The arrangement as claimed in claim 2 wherein the guiding means is a track.

4. The arrangement as claimed in claim 1 wherein said first outlet means includes a connector for joining a pumping conduit means.

5. The apparatus according to claim 1 wherein said second outlet means exhibits a conically decreasing configuration for increasing the speed of said fluid medium being mixed.

6. The apparatus according to claim 1 wherein said means for closing is displaceable to a first position in response to said fluid medium when said impeller is rotated in said one direction and displaceable to a second position in response to said fluid medium when said impeller is rotated in said opposite direction, said means responsive closing said second outlet means to fluid medium flow in said first position and closing said first outlet means to fluid medium flow in said second position.

7. The arrangement as claimed in claim 6 wherein said closing means is a ball.

* * * * *